United States Patent [19]

Scheffel et al.

[11] Patent Number: 4,655,262

[45] Date of Patent: Apr. 7, 1987

[54] REEDS FOR AIR JET LOOMS

[75] Inventors: Walter Scheffel, Hopfenstr. 22, 8832 Weissenburg; Bernd W. Scheffel, Munich, both of Fed. Rep. of Germany

[73] Assignee: Walter Scheffel, Weissenburg, Fed. Rep. of Germany

[21] Appl. No.: 806,262

[22] Filed: Dec. 6, 1985

[30] Foreign Application Priority Data

Dec. 10, 1984 [DE] Fed. Rep. of Germany ..... 3444973

[51] Int. Cl.[4] ..... D03D 47/28

[52] U.S. Cl. ..... 139/435

[58] Field of Search ..... 139/435, 188 R, 192

[56] References Cited

U.S. PATENT DOCUMENTS 3,958,609 5/1976 Zollinger et al. ..... 139/435

4,125,133 11/1978 Kobayashi et al. ..... 139/435

4,244,402 1/1981 Hasegawa et al. ..... 139/435

4,354,534 10/1982 Sulser et al. ..... 139/435

4,371,007 2/1983 Scheffel ..... 139/435

4,458,732 6/1984 Yoshida et al. ..... 139/435

FOREIGN PATENT DOCUMENTS 204949 11/1984 Japan ..... 139/435

*Primary Examiner*—Henry S. Jaudon

*Attorney, Agent, or Firm*—Becker & Becker, Inc.

[57] ABSTRACT

Reeds for an air jet loom. Each reed has a weft insertion channel. The reed teeth are formed in such a way that they have a first region for the guide channel and a straight section for seating-up of the weft thread. The profiling of the teeth allows secondary air streams towards the base of the weft insertion channels. This improves the stability of the thread by keeping the weft closer to the base of the channel.

4 Claims, 4 Drawing Figures

FIG. 1
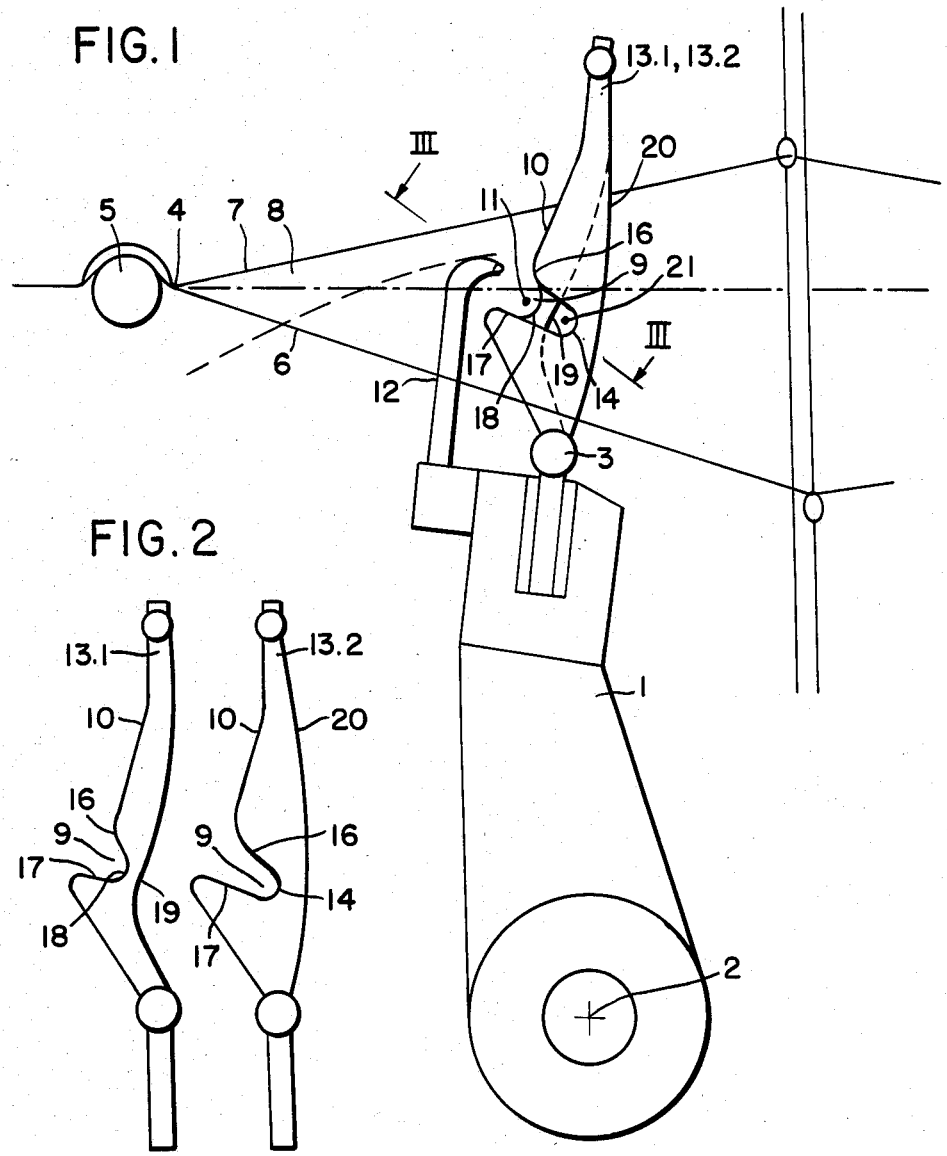
FIG. 2
FIG. 3
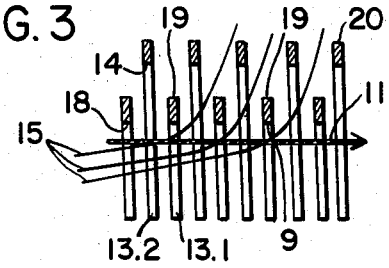
FIG. 4
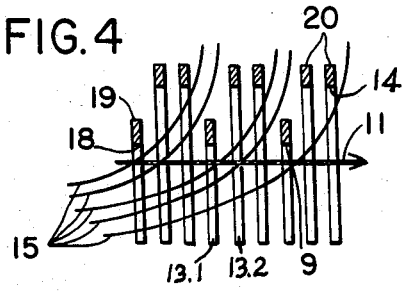

REEDS FOR AIR JET LOOMS

BACKGROUND OF THE INVENTION

1. Field of the Invention

The present invention relates to a reed for an air jet loom, with profiled reed teeth with a weft insertion channel for the insertion of a weft thread.

2. Description of the Prior Art

With heretofore known looms of this general type, the weft insertion channel is embodied and disposed in such a way that there is no favorable pressure compensation or equalization with the atmosphere in the region of the channel. This leads to an unstable condition of the thread as it passes through the weft insertion channel (Swiss Pat. No. 554 435).

Varying the profile of the teeth has been attempted in an effort to achieve an improved stabilization. German Offenlegungsschrift No. 30 03 277 discloses a special profiling of the teeth in order to achieve pressure equalization in the region of the upper and lower sides of the weft insertion channel. However, the device of this reference does not improve the stability of the thread flight, since the guiding effect of the weft insertion channel in the region of its sides is less than was the case with the customary construction.

A further known device disclosed in German Offenlegungsschrift No. 32 14 535, and having variously profiled teeth, has the same drawbacks with regard to the stability.

It is therefore an object of the present invention to provide a reed having teeth with a guide channel for the weft threads, with improved stability of the weft flight.

BRIEF DESCRIPTION OF THE DRAWING

This object, and other objects and advantages of the present invention, will appear more clearly from the following specification in conjunction with the accompanying schematic drawing, in which:

FIG. 1 is a side view of one embodiment of the inventive reed in the weft-insertion position;

FIG. 2 is a side view of differently profiled reed teeth; and

FIG. 3 is a view showing a section through the thread guiding channel and is taken along the line III—III in FIG. 1.

FIG. 4 is another view showing a section similar to that of FIG. 3.

SUMMARY OF THE INVENTION

The reed of the present invention utilizes reed teeth of two configurations. These two configurations are staggered. Each configuration is provided with a recessed portion that mainly forms the weft insertion channel, and a region that forms a weft beating-up surface. The latter is spaced a larger distance from the center of oscillation than the weft insertion channel.

The recessed portions that mainly form the weft insertion channel have two different depths. The first configuration teeth with the shallower recessed portions set the base of the weft insertion channel. The second configuration with the deeper recessed portions affect the air stream in the channel because of a reduced reed thickness in the region of the base of the channel. A reed thickness reduced in this manner improves secondary air streams through the reed in a direction towards the base of the channel. This reduces the tendency of the weft thread to escape from the channel.

A further improvement of the stabilization is achieved by having the deeper recessed portions of the second configuration of teeth extend beyond the rear delimitation of those teeth of the first configuration. In this way, the secondary air stream in the region of the base of the channel faces a reduced reed thickness leaving the reed through the base of the channel. This improves the secondary air stream and prevents the weft from leaving the channel through its open side.

Further advantageous features of the invention will be described subsequently.

DESCRIPTION OF PREFERRED EMBODIMENTS

Referring now to the drawing in detail, the device illustrated in FIG. 1 comprises a reed 1 having a center of oscillation 2 and a reed 3. Disposed on the fell 4 is a temple 5. The spreading warp sheds 6 and 7 form the shed area 8. The front edge of the reed teeth 13 of the reed 3 include the recessed portions 14 and 18 with upper and lower sidewalls 16 and 17 each having a base which connects forming the guide channel 9, and the straight sections 10 for beat-up of the weft. Curved transition zones are provided between the sides 16 and the straight sections 10. To assist the weft 11 during insertion, auxiliary jets 12 are arranged along the channel. The depth of recesses 18 is equivalent to those of customary weft insertion channels.

FIG. 2 illustrates two differently shaped teeth 13.1 and 13.2. The teeth 13.1 have a shallower recessed portion 18 (a depth which is equivalent to those of customary channels) than the teeth 13.2 with their recessed portion 14. The back edges 19 and 20 of the two teeth 13.1 and 13.2 also differ. The teeth 13.1 with the shallower recessed portion 18 have their back edge 19 closer to center of the channel 9 than the back edge 18 of teeth 13.2. The distance of the back edge 19 from the recess 14 might be so large that a second channel 21 is formed. This channel 21 has no function as such. The important fact is that a secondary air stream, which splits off the main air stream through channel 9, can penetrate the reed easier towards the base 18 of the channel, if the teeth have the described configurations.

FIG. 3 and FIG. 4 are sectional views showing the reduced reed thickness as taken along the central sectional line III—III through the weft insertion channel 9 in FIG. 1. As can be seen, the reduced reed thickness is due to the fact that the cross sectional areas of the teeth in the region of the bases of the channels are staggered. The exemplary embodiments illustrated in FIG. 3 and in FIG. 4 show two possible variations. Secondary air streams 15 result from the reduced reed thickness.

The present invention is, of course, in no way restricted to the specific disclosure of the specification and drawing, but also encompasses any modifications within the scope of the appended claims.

What we claim is:

1. In a air jet loom provided with shed forming means, a sley mounted on an axis of oscillation and including a reed having a weft inserting channel formed therein; said reed being formed of a plurality of teeth each having a front and a back edge, the front edge having a first region comprising a recessed portion forming said weft inserting channel and a second region forming the weft beat-up area, said second region being spaced further from said axis than said first region; each said recessed portion includes upper and lower side walls connected by a base; a first of said teeth are formed in a first configuration in which said recess is formed at a first depth, a second of said teeth are formed in a second configuration in which said recess is formed at a second and greater depth, said configurations are such that the distance between the front edge and said back edge of said base is less in said first teeth than in said second teeth; said first and second teeth being interdisposed across the width of the reed.

2. A reed according to claim 1, in which said first and second teeth are alternately arranged across the width of the reed.

3. A reed according to claim 1, in which said first teeth are separated by two adjacently disposed said second teeth across the width of the reed.

4. A reed according to claim 1, in which each of said recesses has an open area for receiving a weft thread and in which said base is disposed opposite said open area; the back edge portions opposite said base of said first teeth are disposed nearer the center of the weft inserting channel than the same back edge portions of said second teeth.

* * * * *